US005597220A

United States Patent [19]

Domenig et al.

[11] Patent Number: 5,597,220

[45] Date of Patent: Jan. 28, 1997

[54] BRACKET FOR MOUNTING A DRAWER GUIDE SUPPORTING A MOVEABLE STRUCTURE FOR USE IN A DESK OR CABINET

[75] Inventors: Georg Domenig; Rick Marsh, both of Kernersville, N.C.

[73] Assignee: Grass America, Inc., Kernersville, N.C.

[21] Appl. No.: 388,995

[22] Filed: Feb. 15, 1995

[51] Int. Cl.[6] ..... A47B 88/00

[52] U.S. Cl. ..... 312/334.4; 312/334.7

[58] Field of Search ..... 312/330.1, 334.7, 312/334.4, 334.1

[56] References Cited

U.S. PATENT DOCUMENTS

| | | | |
|---|---|---|---|
| 4,193,649 | 3/1980 | Sharon | 312/334.4 |
| 4,881,826 | 11/1989 | Grass | 312/334.1 |

FOREIGN PATENT DOCUMENTS

| | | | |
|---|---|---|---|
| 0226910 | 9/1962 | Austria | 312/334.4 |

*Primary Examiner*—Peter M. Cuomo
*Assistant Examiner*—Gerald A. Anderson
*Attorney, Agent, or Firm*—Petree Stockton, LLP

[57] ABSTRACT

A bracket for mounting a drawer guide supporting a moveable structure for use in a desk or cabinet with sidewalls and a desk or cabinet opening has a body portion with a bottom surface which carries at least one leg upstanding from the bottom surface for engaging a sidewall of the desk or cabinet and with a top surface spaced from the bottom surface which carries means for supporting a drawer guide in predetermined spaced relationship to the sidewall and desk or cabinet opening to enable movement of the moveable structure supported on the drawer guide through the desk or cabinet opening. The drawer guide is supported on the top surface of the body portion by one or more drawer guide mounting screws receivable in one or more mounting holes formed in the body portion top surface. The top surface of the body portion may also include portions defining a wing member engagable by the desk or cabinet opening.

5 Claims, 4 Drawing Sheets

BRACKET FOR MOUNTING A DRAWER GUIDE SUPPORTING A MOVEABLE STRUCTURE FOR USE IN A DESK OR CABINET

BACKGROUND OF THE INVENTION

1. Field of the Invention

The present invention relates to desk or cabinet mounting brackets and more particularly to a new and improved mounting bracket for use in connection with a drawer guide for supporting a moveable structure in a desk or cabinet which has opposing sidewalls and a desk or cabinet opening, the bracket including a body portion having a bottom surface which carries at least one leg upstanding from the bottom surface for engaging a sidewall of the cabinet and a top surface spaced from the bottom surface and having portions defining at least one hole for receiving a drawer guide mounting screw for supporting a drawer guide in predetermined spaced relationship to the sidewall and the desk or cabinet opening to enable movement of the moveable structure supported on the drawer guide through the desk or cabinet opening.

2. Description of the Prior Art

A particular type of desk or cabinet for use, for example, in kitchens, bathrooms and the like is provided with one or more pairs of opposing sidewalls, each of which sidewall pairs, together with the top and bottom of the desk or cabinet, defines a desk or cabinet opening within which it may be desirable to install one or more moveable pull-out structures such as a pull-out tray, a pull-out shelf, a pull-out bin or the like. In order to provide support for the moveable structure, it is necessary to install a drawer guide in the desk or cabinet. A type of drawer guide in common use is attached to the desk or cabinet with one of its ends positioned at or near the desk or cabinet opening and its opposite end positioned on the back wall of the desk or cabinet opposite the desk or cabinet opening. The drawer guide attached to the desk or cabinet is not moveable, but serves as a supporting track on which the moveable structure rolls or slides in and out of the desk or cabinet through the desk or cabinet opening.

Generally, the end of the drawer guide at or near the desk or cabinet opening is attached directly to a sidewall of the desk or cabinet by a mechanical fastener such as a nail, braid, screw or the like which is received through a hole in the drawer guide directly into the sidewall of the desk or cabinet. The desk or cabinet opening may have a face frame, in which case, the drawer guide may be attached in like manner to the face frame rather than the sidewall. Usually, the desk or cabinet opening is provided with a door which is hinged on one of its lateral edges to the sidewall or face frame, as the case may be, and the door can be closed or opened to enable the moveable structure to be pulled out of the desk or cabinet opening. In installations of the type described, when the door of the desk or cabinet is opened, the hinged edge of the open door often impinges on the desk or cabinet opening and partially obstructs movement of the moveable structure through the opening. Further, many of the types of hinges used in such installations are configured and dimensioned such that the hinges themselves impinge on the desk or cabinet opening and likewise partially obstruct movement of the moveable structure through the opening.

Accordingly, in such installations, it is necessary to provide an additional desk or cabinet frame member within the desk or cabinet to space the drawer guide from the sidewall or face frame in order to enable the movable structure to move in and out of the desk or cabinet opening without being obstructed by the impinging door or hinges. Moreover, it is necessary in such installations to position and fasten one end of the drawer guide at or near the desk or cabinet opening, horizontally align the drawer guide, and fasten the opposite end of the drawer guide to the back wall of the desk or cabinet.

There is a current need to provide a bracket for mounting a drawer guide for supporting a moveable structure in a desk or cabinet having opposing sidewalls and portions defining an opening which provides an efficient and relatively simple method for supporting the drawer guide in a predetermined spaced relationship to the sidewall and the desk or cabinet opening to enable movement of the movable structure supported on the drawer guide through the desk or cabinet opening and which at the same time furnishes a prepositioned support for horizontal alignment of the drawer guide. The present invention addresses this need.

SUMMARY OF THE INVENTION

The general purpose of the present invention, which will be described subsequently in greater detail, is to provide a new and improved bracket for mounting a drawer guide for supporting a moveable structure in a desk or cabinet which has opposing sidewalls and portions defining a desk or cabinet opening and for supporting the drawer guide in predetermined spaced relationship to the sidewall and desk or cabinet opening to enable movement of the moveable structure supported by the drawer guide through the opening and at the same time, providing a prepositioned support for horizontal alignment of the drawer guide.

To attain this purpose, a representative embodiment of the present invention is illustrated in the drawings. The bracket of the present invention makes use of a body portion having a bottom surface which carries at least one leg upstanding from the bottom surface for engaging a sidewall of the desk or cabinet. The body portion also has a top surface in which is formed at least one hole for receiving a drawer guide mounting screw inserted through a hole formed in the drawer guide to support the drawer guide. The bottom surface of the bracket body portion is spaced from body portion top surface and the supported drawer guide to enable movement of the moveable structure supported by the drawer guide through the desk or cabinet opening. The desk or cabinet of the type with which the bracket of the present invention is intended for use has an opening with a door hinged to one of the sidewalls defining the opening or to a face frame of the opening. The drawer guide supported on the top surface of the body portion of the bracket is spaced from the sidewall of the desk or cabinet such that the moveable structure can be moved through the desk or cabinet opening without being obstructed by impingement in the opening of the hinged edge of the open door or the hinges which support the open door.

In the bracket of the present invention, alternate support position for the drawer guide on the top surface of the bracket body portion may be provided by a plurality of holes formed in the top surface, each for receiving a drawer guide mounting screw. Additional support for the bracket on the desk or cabinet can be provided with a wing member defined by portions of the top surface which wing member has a hole through which a screw can be inserted into the desk or cabinet opening. Further support for the bracket on the desk or cabinet can be furnished by a second leg upstanding from the bottom surface of the bracket body portion for engaging the sidewall of the desk or cabinet.

Moreover, boreholes may be formed in the sidewall of the desk or cabinet in predetermined spaced apart vertical alignment for receiving the leg or legs upstanding from the bottom surface of the bracket body portion with one end of the drawer guide supported on the top surface of the bracket body portion, and corresponding boreholes can be formed in the back wall of the desk or cabinet in predetermined spaced apart vertical alignment for attaching the opposite end of the drawer guide to assure horizontal alignment of the installed drawer guide.

The foregoing focuses on the more important features of the invention in order that the detailed description which follows may be better understood and in order that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and of being carried out in various ways.

It is to be understood that the phraseology and terminology employed herein are for the purpose of description and are not to be regarded as limiting. Those skilled in the art will appreciate that the conception upon which this disclosure is based may readily be used as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a new and bracket for mounting a drawer guide in a desk or cabinet which has all of the advantages, and more, of prior art devices and none of the disadvantages.

It is another object of the present invention to provide a new and improved bracket of the type described that is more reliable and functional than those presently available.

Yet another object of the present invention is to provide a bracket which enables mounting a drawer guide for supporting a moveable structure in a desk or cabinet having opposing sidewalls and portions defining a desk or cabinet opening in predetermined spaced relationship to the sidewall and the desk or cabinet opening to enable movement of the moveable structure supported by the drawer guide through the desk or cabinet opening without the necessity of providing additional desk or cabinet frame members within the desk or cabinet to space the drawer guide from the sidewall or face frame of the desk or cabinet to enable such movement.

Still another object of the present invention is to provide a bracket of the type described for mounting a drawer guide in a predetermined position on the sidewall of the desk or cabinet such that horizontal alignment of the installed drawer guide is assured.

These, together with other objects of the present invention, along with the various features of novelty which characterize the invention, are pointed out with particularity in the claims annexed to and forming a part of this disclosure.

For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

The invention will be better understood and objects other than those set forth above will become apparent when consideration is given to the following detailed description. Such description makes reference to the annexed drawings wherein.

DESCRIPTION OF THE PREFERRED EMBODIMENT

Figure 10:
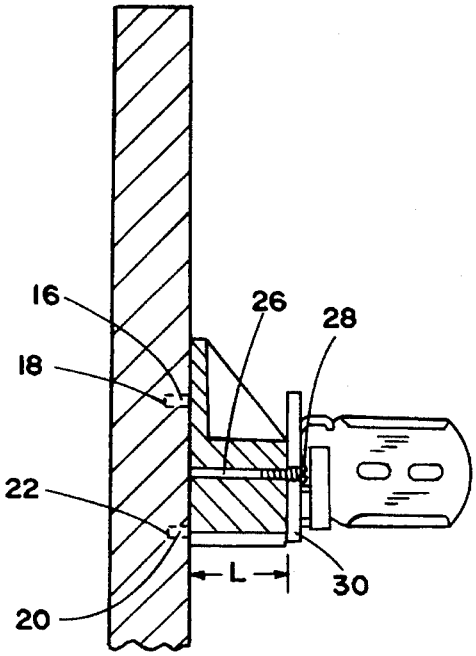
FIG. 10 is a fragmentary side view of a drawer guide mounted on a sidewall of a desk or cabinet and supported by the bracket shown in FIGS. 1, through 8.
Figure 12:
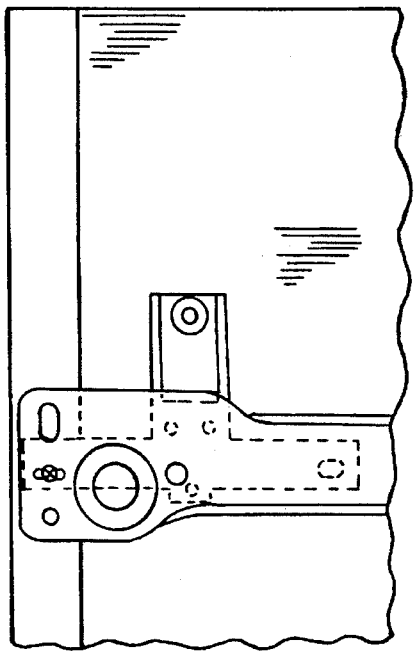
FIG. 12 is a fragmentary view of a drawer guide mounted on a sidewall of a desk or cabinet and supported in an alternate position by the bracket shown in FIGS. 1 through 8.
Figure 13:
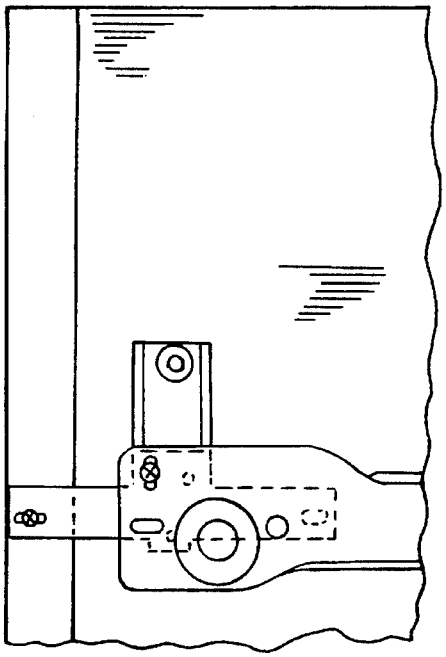
FIG. 13 is a fragmentary view of a drawer guide mounted on a sidewall of a desk or cabinet and supported in a second alternate position by the bracket shown in FIGS. 1 through 8.
Figure 11:
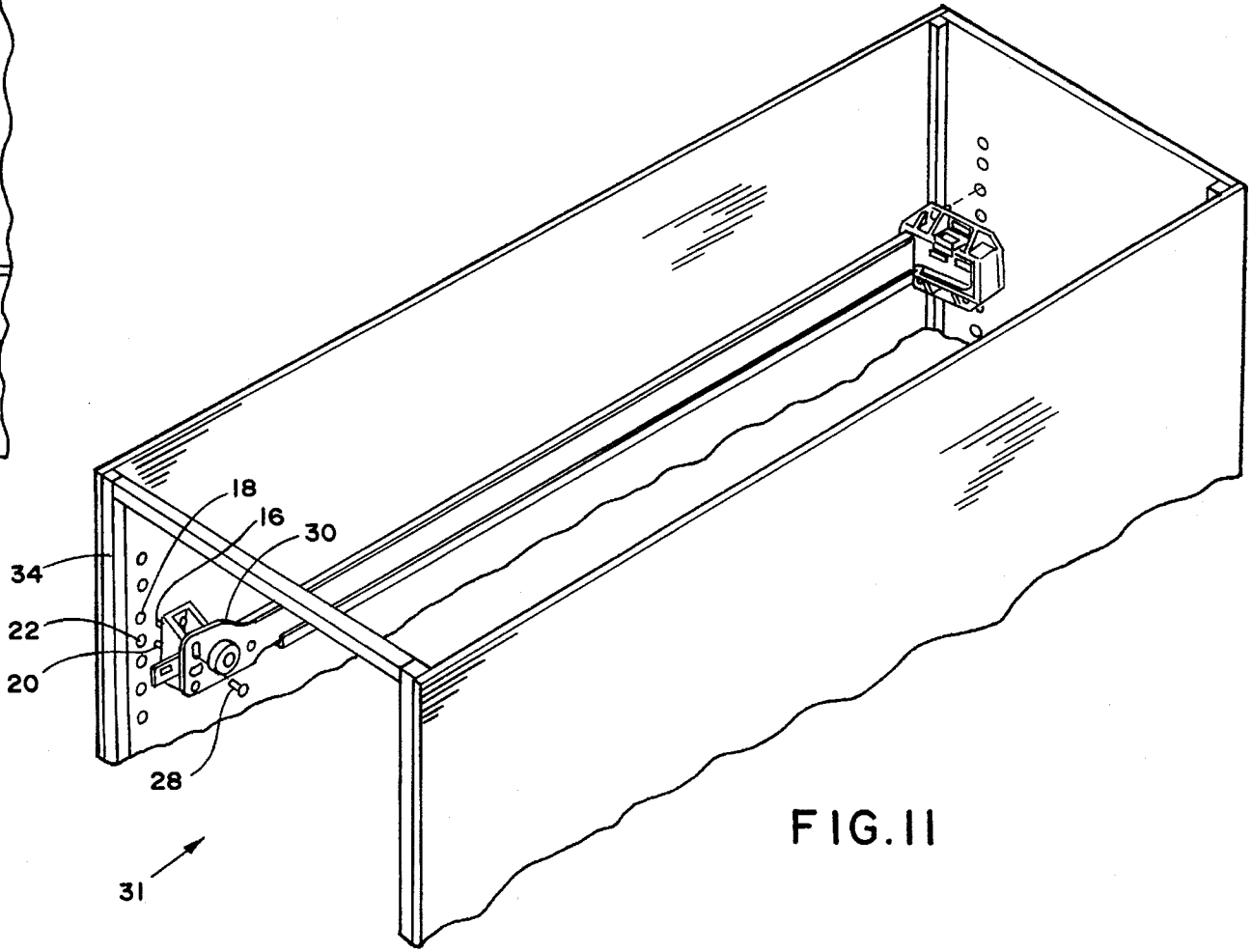
FIG. 11 is a perspective and fragmentary view of a drawer guide mounted on a sidewall of a desk or cabinet and supported by the bracket shown in FIGS. 1 through 8.
Figure 14:
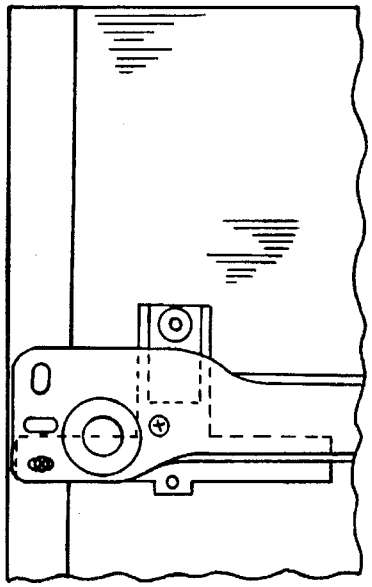
FIG. 14 is a fragmentary view of a drawer guide mounted on a sidewall of a desk or cabinet and supported in a third alternate position by the bracket shown in FIGS. 1 through 8.

Referring now the drawings, and specifically to FIG. 1–8, a bracket, shown generally as 10, for mounting a drawer guide has a body portion 12 with a bottom surface 14 which carries at least one upstanding leg 16 engageable in a hole 18 formed in a desk or cabinet sidewall as shown in FIGS. 10 and 11 for supporting bracket 10 on the sidewall. Additional support for bracket 10 on the sidewall may be furnished by a second upstanding leg 20 carried by bottom surface 14 engageable in a second hole 22 formed in the desk or cabinet sidewall.

Figure 6:
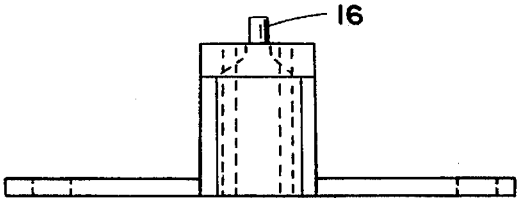
FIG. 6 is a front elevational view of the bracket shown in FIGS. 1 through 5.
Figure 3:
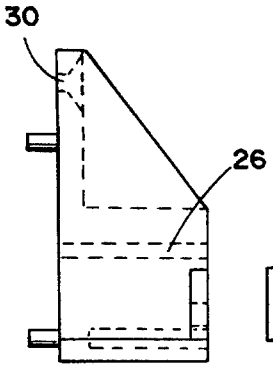
FIG. 3 is a left side elevational view of the bracket shown in FIGS. 1 and 2.
Figure 1:
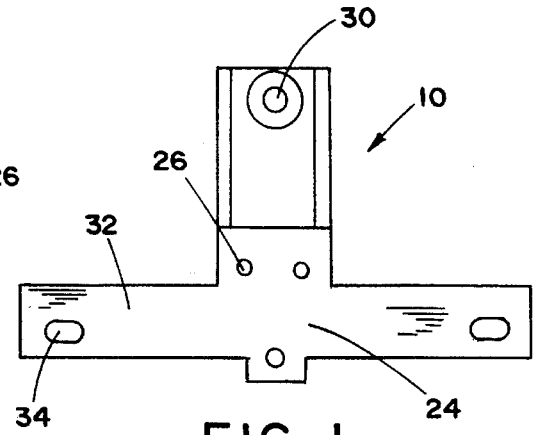
FIG. 1 is a plan view of the bracket comprising the present invention.
Figure 2:
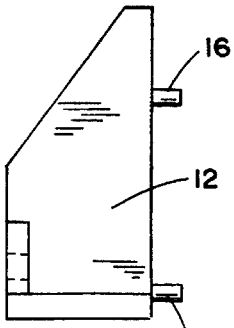
FIG. 2 is a right side elevational view of the bracket shown in FIG. 1.
Figure 5:
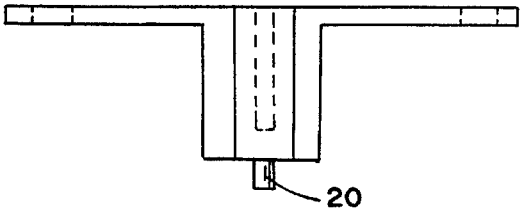
FIG. 5 is a rear elevational view of the bracket shown in FIGS. 1 through 4.
Figure 4:
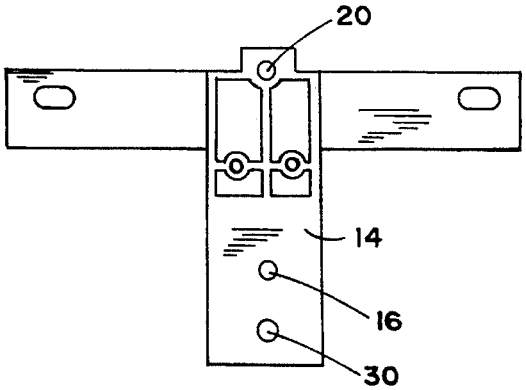
FIG. 4 is a bottom view of the bracket shown in FIGS. 1 through 3.
Figure 7:
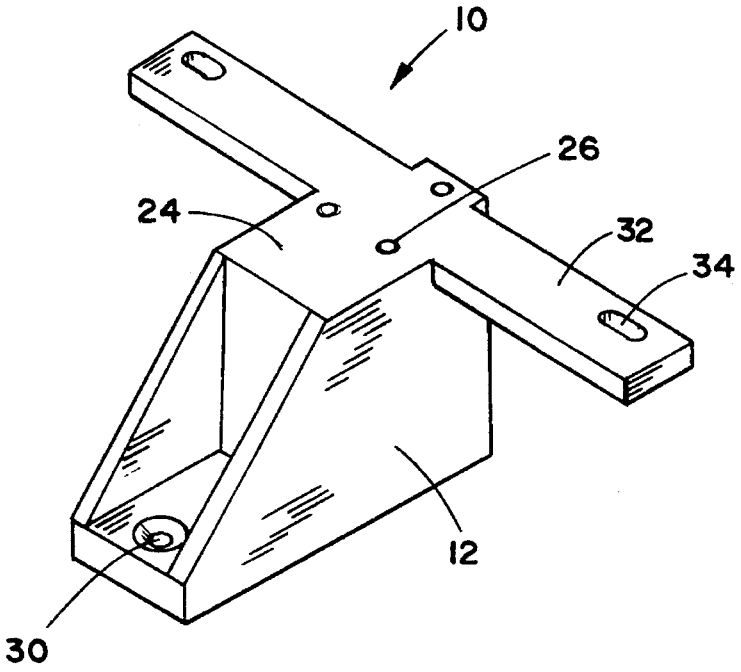
FIG. 7 is a top perspective view of the bracket shown in FIGS. 1 through 6.
Figure 8:
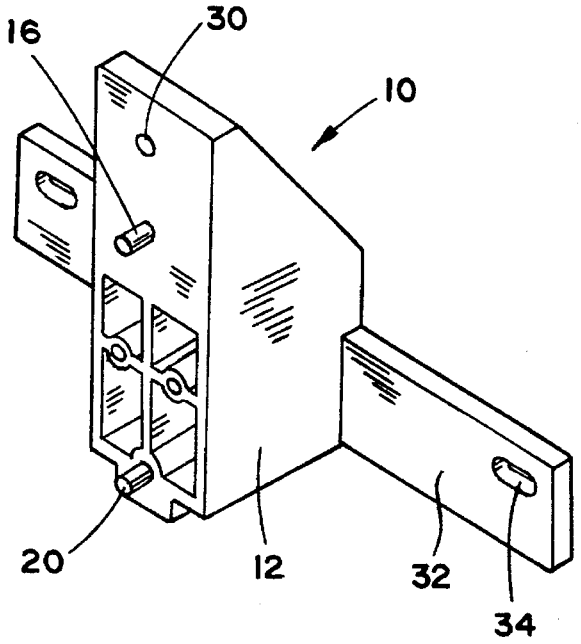
FIG. 8 is a bottom perspective view of the bracket shown in FIGS. 1 through 7.
Figure 9:
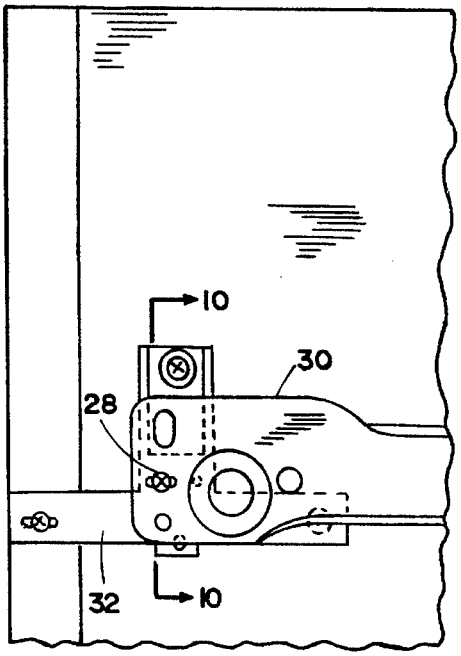
FIG. 9 is a fragmentary top view of a drawer guide mounted on a sidewall of a desk or cabinet and supported by the bracket shown in FIGS. 1 through 8.

Body portion 12 of bracket 10 also includes top surface 24 which has portions defining at least one hole 26 for receiving a fastener such as mounting screw 28 inserted through a hole formed in drawer guide 30 and supporting draw guide 30 on top surface 24 as shown in FIGS. 9–11. Bottom surface 14 of bracket body portion 12 is spaced from top surface 24 a predetermined distance L as shown in FIG. 10, and likewise supported draw guide 30 is spaced a predetermined distance L from the sidewall to enable a moveable structure supported by drawer guide 30 to move freely through an opening, shown generally as 31 in FIG. 11, defined between the spaced apart opposing sidewalls of the desk or cabinet without encountering obstruction caused by, for example, impingement in defined opening 31 of the hinged edge of an open cabinet door hinged to one of the sidewalls or a face frame of the sidewalls or by portions of hinges supporting the door which likewise impinge in defined opening 31.

Under normal conditions, with the end of drawer guide 30 fastened at its end opposite defined opening 31 to the back wall of the desk or cabinet as shown in FIG. 11, and supporting a moveable structure, the installed mounting bracket 10 cannot pull away from the desk or cabinet sidewall to disengage legs 16 and 20 received in holes 18 and 20 of the sidewall. However, under certain conditions, for example, warpage of the desk or cabinet or for shipping or storage considerations, it may be desirable to fasten bracket 10 to the desk or cabinet sidewall. In that event, a fastener such as a fastening screw can be inserted through hole 30 formed in body portion 12 and into the desk or cabinet sidewall as shown in FIG. 9. Additionally, top surface 24 may have additional portions defining a wing member 32, and fastener such as a fastening screw may be inserted through hole 34 formed in wing member 32 and into a face frame member 34 of the defined desk or cabinet opening 31 as shown in FIG. 11 for still further support.

The device forming the present invention is designed primarily for use in a desk or cabinet with an arrangement of boreholes formed in the sidewall of the desk or cabinet in predetermined spaced apart vertical alignment disposed at or near defined opening 31 for receiving legs 16 and 20 carried on bottom surface 14 of bracket body portion 12 and with a corresponding arrangement of boreholes formed in the back wall of the desk or cabinet in predetermined spaced apart vertical alignment for attaching the end of the drawer guide opposite defined opening 31 as shown in FIG. 11. The respective borehole arrangements are positioned to cooperatively receive bracket 10 and one end of supported drawer guide 30 at or near opening 31 and to receive the opposite end of drawer guide 30 at the back wall of the desk or cabinet in predetermined horizontal alignment of drawer guide 30.

Obviously, any number of materials may be used to form the bracket and its components described herein, and exceptional success has been experienced by the use of rigid or semirigid plastic material, although other materials may be used when greater or lesser support is necessary.

With respect to the descriptions set forth above, optimum dimensional relationship for the parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principles of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A bracket for mounting a drawer guide supporting a moveable structure in a furniture article, the furniture article having opposing sidewalls and a defined opening, the apparatus comprising: a body portion having a bottom surface and a top surface; means carried by said bottom surface for supporting said body portion on one of the sidewalls of the furniture article proximate the defined opening; and means carried by said top surface for supporting the drawer guide in predetermined spaced relationship to said sidewall and said defined opening, said bottom surface being spaced from said drawer guide support means carried by said top surface to enable movement of the moveable structure supported on said drawer guide through the defined opening, said drawer guide support means being positioned on said top surface to support said drawer guide in substantially horizontally aligned relationship to said sidewall, and said drawer guide support means comprising a plurality of holes defined in said top surface, each for receiving a drawer guide fastening screw.

2. The bracket as claimed in claim 1, said top surface having portions defining a wing member.

3. The bracket as claimed in claim 2, said wing member having portions defining a hole for receiving a wing member fastening screw.

4. The bracket as claimed in claim 3, said body portion support means comprising at least one leg upstanding from said bottom surface for engaging said sidewall.

5. The bracket as claimed in claim 4, said body portion support means further comprising a second leg upstanding from said bottom surface for engaging said sidewall.

* * * * *